US007281991B2

(12) United States Patent
Gilbert et al.

(10) Patent No.: US 7,281,991 B2
(45) **Date of Patent: *Oct. 16, 2007**

(54) HOLLOW GOLF CLUB WITH COMPOSITE CORE

(75) Inventors: Peter J. Gilbert, Carlsbad, CA (US); Tomas Diaz, Winchester, CA (US); Christopher R. Kays, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 10 days.

This patent is subject to a terminal disclaimer.

(21) Appl. No.: 11/180,469

(22) Filed: Jul. 13, 2005

(65) Prior Publication Data

US 2005/0245325 A1 Nov. 3, 2005

Related U.S. Application Data

(63) Continuation-in-part of application No. 10/606,317, filed on Jun. 25, 2003, now abandoned.

(51) Int. Cl.
*A63B 53/04* (2006.01)

(52) U.S. Cl. ..... 473/342; 473/345; 473/335

(58) Field of Classification Search ..... 473/334–338, 473/342, 332, 345–346, 326, 350
See application file for complete search history.

(56) References Cited

U.S. PATENT DOCUMENTS 1,894,706 A * 1/1933 Reach ..... 473/310
3,979,122 A * 9/1976 Belmont ..... 473/336
4,792,139 A 12/1988 Nagasaki et al.
4,798,383 A 1/1989 Nagasaki et al.
4,884,812 A 12/1989 Nagasaki et al.
4,964,640 A 10/1990 Nakanishi et al.
5,184,823 A 2/1993 Desboilles et al.
5,328,175 A 7/1994 Yamada
5,421,577 A 6/1995 Kobayashi
5,429,358 A * 7/1995 Rigal et al. ..... 473/309
5,439,223 A * 8/1995 Kobayashi ..... 473/334
5,904,628 A 5/1999 MacKay, Jr. et al.
5,985,197 A 11/1999 Nelson et al.
6,248,025 B1 6/2001 Murphy et al.
6,319,150 B1 11/2001 Werner et al.
6,398,666 B1 6/2002 Evans et al.
6,616,546 B2 * 9/2003 Cho ..... 473/329
2001/0055996 A1 12/2001 Iwata et al.
2003/0083151 A1 5/2003 Nakahara et al.
2003/0148818 A1 * 8/2003 Myrhum
2004/0023730 A1 * 2/2004 Nagai
2005/0009626 A1 1/2005 Imamoto et al.
2005/0124437 A1 * 6/2005 Imamoto

* cited by examiner

*Primary Examiner*—Stephen Blau
(74) *Attorney, Agent, or Firm*—D. Michael Burns

(57) ABSTRACT

A hollow golf club having a hosel sleeve weight made from tungsten material in the upper hosel area and a tungsten toe plug in the lower toe portion of the club head. This combination creates an increase in the moment of inertia of the club head about the x, y and z axes of the club head. A composite core is bladder molded into a cavity in the club head to provide support for a relatively thin front face and the composite core is visible on the rear surface of the club head. The core material is less dense and has greater flexibility than the front face.

16 Claims, 7 Drawing Sheets

HOLLOW GOLF CLUB WITH COMPOSITE CORE

CROSS-REFERENCE TO RELATED APPLICATIONS

This application is a continuation-in-part of U.S. application Ser. No. 10/606,317, which was filed Jun. 25, 2003 now abandoned, and is incorporated herein in its entirety by express reference thereto.

FIELD OF THE INVENTION

This invention relates to a hollow golf club head of the utility-iron type. More specifically, it relates to a golf club head having a composite core, and a toe plug and hosel sleeve weight.

BACKGROUND OF THE INVENTION

The desire for perimeter weighting in a golf club iron is well known in the art. This desire stems from the fact that as the mass of the club is distributed towards the perimeter, the trajectory of the hit ball becomes more accurate, despite off-center hits away from the sweet spot of the golf club face or hitting surface. Consequently, many modern golf club irons have a rear cavity that extends towards the rear side of the face surface of the iron. The weight saved, by creating a rear cavity in the club, is re-distributed to the perimeter of the golf club head. A large cavity volume equates to a greater amount of metal mass that can be redistributed to the perimeter of the golf club head. It is often desirable to enclose the cavity volume, therein creating a club head that is a compromise between a metal wood and an iron-type club. These clubs have various names such as hybrids or utility clubs.

Conventionally, golf club heads were made from a single material, usually stainless steel for some metal woods and iron type clubs, and recently a large shift in the use of titanium for metal woods. Carbon fiber composite materials have been introduced in an effort to decrease the weight of the golf club head while subsequently increasing the club head's volume. Composite materials have been used widely to reinforce thin club faces, while providing "feel" and in some instances vibration dampening.

Typically, in an iron club head, composite inserts are used to support the rear surface of the front face. They are generally sheets of composite attached with an adhesive. The lightweight composite allows for the face to be thin and therefore a larger face and bigger sweet spot.

The use of composites and perimeter weighting is often desired so that weight may be shifted to other more desired areas of the club head. One concern to the designers of golf clubs is the ability of the club head to resist twisting during the golf swing. It is desirable to provide a golf club that optimizes the moment of inertia (MOI) such that twisting will be reduced, and also such that ball speed will be similar over a large region to create a larger sweet zone. The present invention has created an improvement in optimizing the MOI of the club head by shifting club head weight to or from the toe region and higher hosel areas.

SUMMARY OF THE INVENTION

The present invention is directed to a golf club including a combination metal and composite body. The body is hollow and comprises a front face in which an impact face insert is included, a toe portion that includes a toe plug that is secured into a receptacle (preferably screwed into a threaded receptacle), a heel portion having a hosel extending from it for attaching to a shaft, the hosel having a sleeve weight attached therein. The metal portion of the body includes, at least, the front face and preferably includes the toe portion, the heel and sole portions, and hosel. The body has means for attaching the impact face insert. The composite material forms the inner portion of the body and preferably includes a portion juxtaposed with the front face so as to provide structural support for a thin front face. A section of the composite core is visible from the rear of the club head.

In one embodiment of the invention, a composite core and metallic body are combined to form a hollow golf club head. The composite is used to structurally support a thin front face, and also for an increased Coefficient of Restitution (COR). Preferably, the front face is of a higher density and lower Young's Modulus than the composite core.

An embodiment of the invention is comprised of a metal body member that may be cast, forged, stamped or made by metal injection molding. The body member is placed in a mold and a composite core is biasly inflated and expanded against the metal body and mold, preferably by a bladder method. Preferably, the composite core is located such that the composite material is juxtaposed against portions of the metal body and mold. The mold is used as a boundary for specific regions of the club head where the metal body has an opening(s) such that the exterior of the club is partially metal and partially composite. Embodiments of the invention are provided in both hollow irons as well as metal woods.

An embodiment of the invention does not provide a composite to structurally reinforce the front face, but does provide a composite to create the rear portion of the club head which is visible therein. This is provided by having a composite membrane

DETAILED DESCRIPTION OF THE INVENTION

Figure 1:
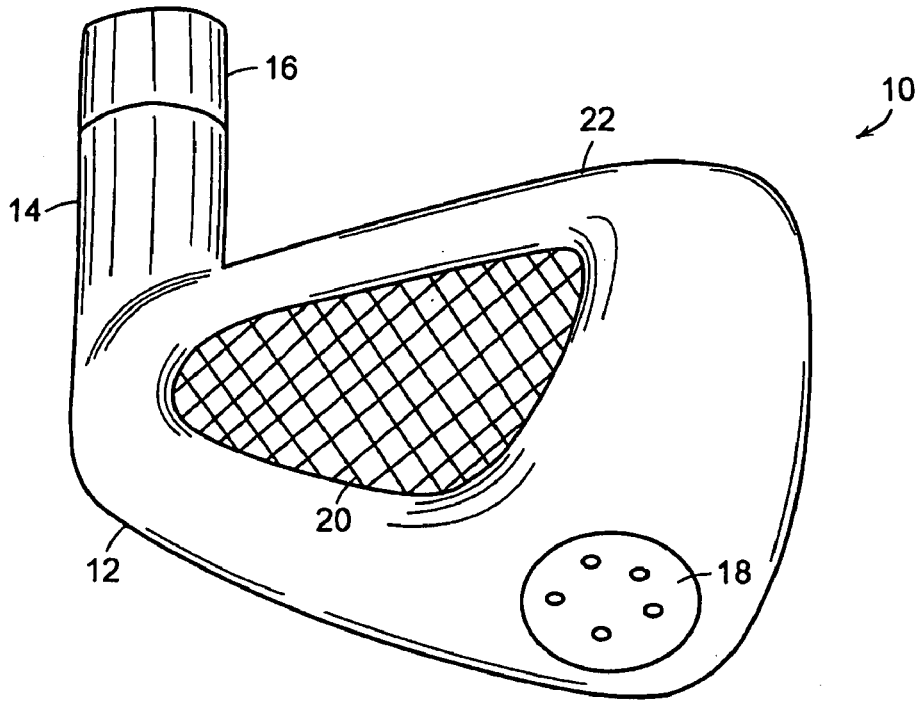
FIG. 1 is a rear toe pictorial view showing the position of the toe plug, hosel sleeve weight and visible composite core.
Figure 2:
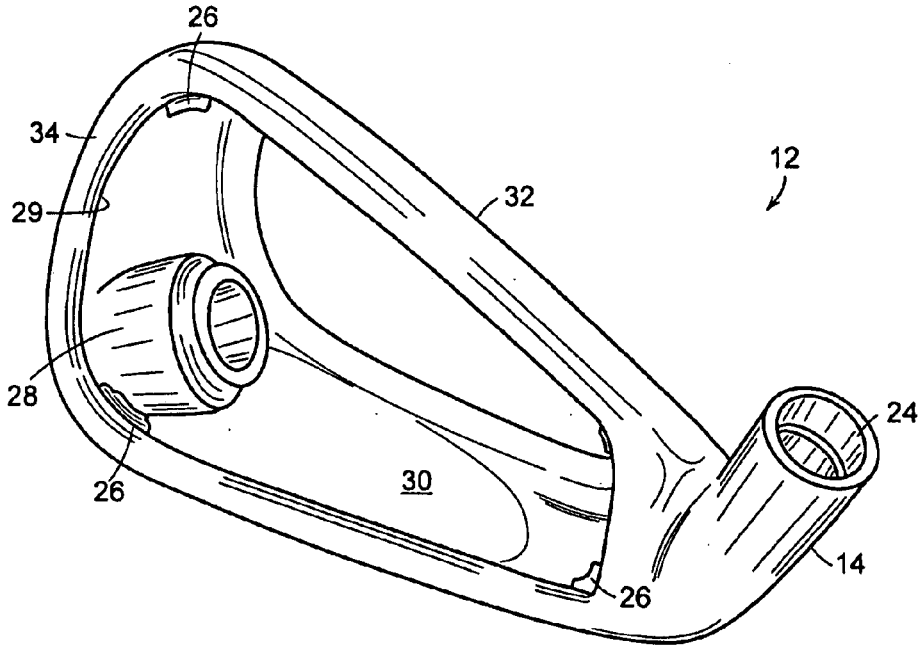
FIG. 2 is a front pictorial view of the present invention showing the receptacle for the toe plug.
Figure 3:
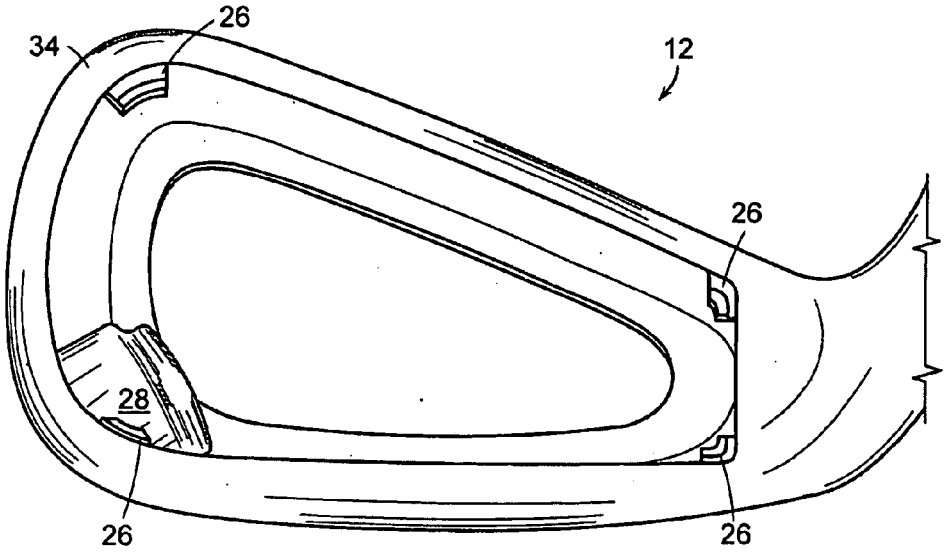
FIG. 3 is a front elevational view showing the front and rear openings of the body, the receptacle and shads for placement of an impact plate insert.

The present invention presents a utility iron designed to provide golfers with an alternative and easier-to-hit replacement for long irons such as the 4, 3, and 2 iron clubs. The innovative design and construction of the present invention provides for a more manageable trajectory versus that of a fairway metal wood, which by design inherently yields a higher loft than a comparable long iron. The club head of the present invention will also provide a more playable trajectory when compared to that a long iron.

An embodiment of an iron golf club head 10 of the present invention is shown in FIGS. 1 to 7. The body 12 of the golf club head 10 includes: a substantially hollow metal construction; a front face 34 with a front opening 30; a sole portion 17; a toe portion 19 having an open port 31 with a receptacle 28, preferably threaded, in the lower toe portion 19; a heel portion 13; a hosel 14; and a rear opening 32. A toe plug 18, preferably made from tungsten, is inserted into the open port 31, as discussed later. A hosel sleeve weight 16 of a size and configuration is inserted into an opening 24 in the hosel 14, as discussed later, and an impact plate 36 of a size and shape for insertion within the front opening 30 of the front face 34. The body 12 has a cavity 27 defined therein.

Figure 5:
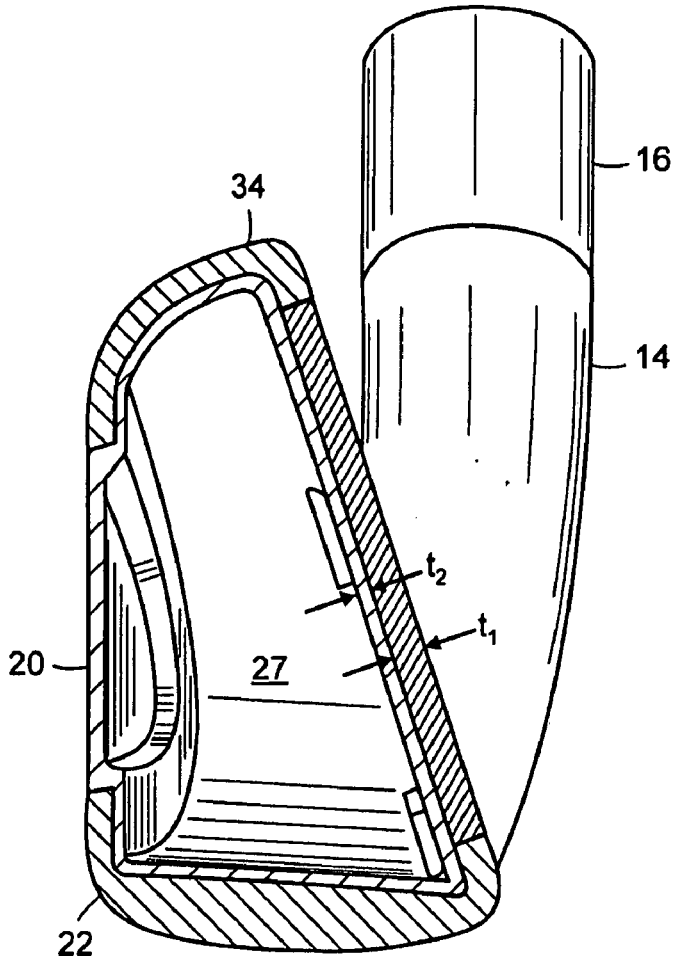
FIG. 5 is a toe cross-sectional view depicting the bladder molded composite core.

A lightweight composite core 20 is placed with bias into the cavity 27, and is juxtaposed against an inner surface 29 of the body 12, so as to internally reinforce the body 12, while also providing support for the impact plate 36. Composite core 20 is visible on the rear of club head 10, as shown in FIGS. 1 and 5. Body 12 is preferably made from a 431 stainless steel, and may be cast, forged, stamped or made by metal injection molding process. Reinforcing body 12 with the lightweight composite core 20 allows for body 12 to be thinned down in select regions. The thinned down regions permit the mass distribution optimization (Center of Gravity and Moment of Inertia) of the club head 10, and also stiffening of impact plate 36 that may be relatively flexible due to the thin structure. It is preferable that the impact plate insert 36 be formed from titanium as the composite core 20 will provide structural support. The impact plate 36 may be cast, stamped or forged and an alternate material would be very thin stainless steel.

The body 12, as well as the impact plate 36, can be made relatively thin because of the support provided by composite core 20. The thickness ($t_1$) of the impact plate 36 is preferably between about 0.04 inch to 0.12 inch, and more preferably, between about 0.06 inch to about 0.1 inch. The thickness ($t_2$) of the composite core 20 is preferably between 0.02 inch to about 0.10 inch. The front face 34 is reinforced by composite core 20 to provide face flexibility characteristics that yield maximum Coefficient of Restitution (COR) values from about 0.8 to about 0.9. The COR of club head 10 may vary across the front face 34 to normalize ball speed and provide an enlarged sweet zone for added forgiveness. While the COR of club head 10 of the present invention may be about 0.8 at the face center (C on FIG. 6), it is greater than 0.8 away from the face center. Generally, the stiffness of the front face 34 is greatest at the face center C, and then becomes progressively more flexible away from the face center C. For ease of assembly there are a plurality of tabs 26 positioned about the perimeter of the front opening 30 for aligning the impact plate 36. The coefficient of restitution is obtained under test conditions, such as those specified by the USGA. The standard USGA conditions for measuring the coefficient of restitution is set forth in the USGA Procedure for Measuring the Velocity Ratio of a Club Head for Conformance to Rule 4-1e, Appendix II available from the U.S.G.A.

As stated above, club head 10 is a hollow style club head having thin walls in select regions, especially the impact plate 36. The thin regions are then structurally reinforced with lightweight composite core 20 that juxtaposes against the inner surfaces of both the body 12 and the plate 36. Composite core 20 may be made from such materials as plastic, carbon graphite or any lightweight material preferably with a density less than 4.5 gm/cc, and more preferably about 1.6 gm/cc. The composite core 20 may be inserted into the golf club 10 by a variety of methods. One such method uses a well-known bladder process. This process comprises inserting a composite core 20 into the cavity 27, and then a bladder (not shown) preferably made from latex, silicone, or similar materials, is introduced through open port 31. The assembly comprises, the metal golf club body 12, composite core 20, and bladder. The bladder is positioned in the mold (not shown), which is used as a boundary for specific regions of the club head 10, wherein the composite core 20 is visible in a rear opening 32 of the rear surface 22. Thus, the viewable exterior of the club head 10 is partially metal and partially composite. A source of pressurized gas, usually air, (source not shown) is introduced through open port 31 to inflate and expand the bladder, and thereby cause plies of the composite core 20 to biasly expand against the inner walls of golf club 10 and against the internal walls of the mold. The internal walls of the tool are used as a boundary for a region of composite or plastic that is visible to the outside of golf club 10. Heat may be provided at a predetermined temperature for a selected period of time, i.e., a time sufficient to allow proper curing of the composite material. After depressurizing, the bladder may be removed through the port 31, and the golf club head 10 may be removed from the mold. The exterior of the resultant club head 10 is partially metal body 12 and partially composite core material 20 with an internal volume between about 20 cc to 50 cc.

Figure 4:
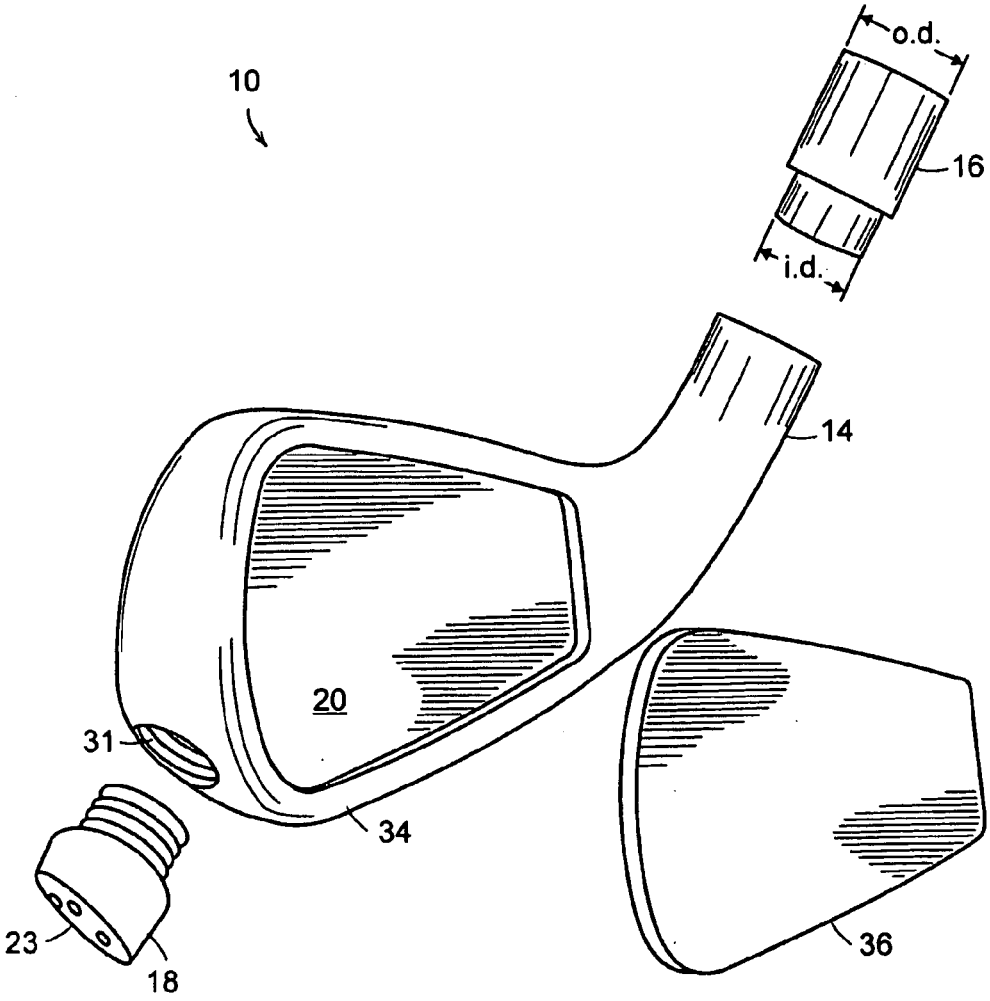
FIG. 4 is a expanded view of the invention illustrating the body, hosel sleeve weight, toe plug, composite core and the impact plate insert.
Figures 6, 7:
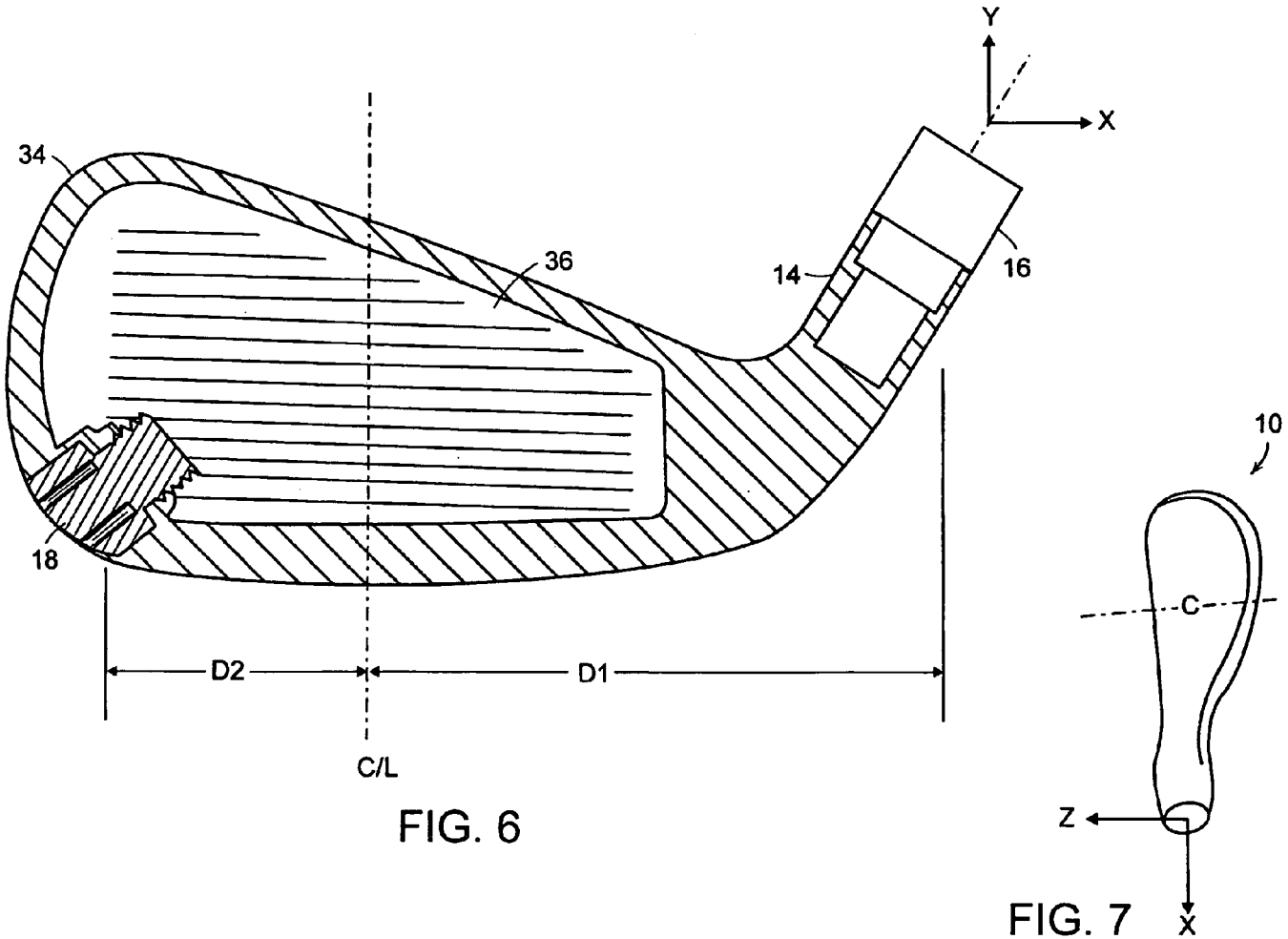
FIG. 6 is a front face schematic depicting the center line position nomenclature relative to the x and y axes and positioning of the hosel sleeve weight and toe plug relative to the center of the club face.
FIG. 7 is a top view schematic depicting the center line position relative to the x and z axes.

Toe plug 18 is secured into the open port 31 (as best seen in FIGS. 1, 4 and 6), which has the receptacle 28, preferably the toe plug 18 is screwed into the receptacle 28 which is preferably threaded. The top portion 23 of the toe plug 18 is curved to match the contour of the toe surface. Toe plug 18 has a density of about 14 grams per cubic centimeter, and the weight may be varied to accommodate various swing weights, preferably by varying its length. The weight of toe plug 18 is dependent on the desired swing weight, with preferable weight ranges from about 10 grams to 30 grams. Preferably the toe plug 18 is made of tungsten material.

The hosel sleeve weight 16, preferably made from tungsten, is inserted into the hosel 14 and can range from 16 grams to 34 grams, while having an outside diameter (o.d.) of about 0.54 inch and an inside diameter (i.d.) of about 0.37 inch. By employing tungsten and varying the length of the hosel sleeve weight 16 the weight increase in the hosel can range between 7 to 11 grams for length of about 0.575 inch, and 12 to 19 grams for a length of 1 inch. The increase in weight in the high hosel area combined with the increase of weight in the lower toe portion creates a significant change in the moment of inertia (MOI) of the club head. For a golfer, the easiest explanation of MOI is that MOI is directly related to torque, and the greater the torque, the greater ability of the club head to resist twisting during the swing. FIGS. 6 and 7 schematically display various axis associated with calculating MOI. The three most significant axes are the x, y, and z axes. For the present invention golf club head the MOI about the x axis ranges from 55 to 65 kg-mm. This is a significant improvement over conventional long irons which the present invention is designed to replace. The present invention provides a MOI along the y axis between about 220 to about 300 kg-mm, and a MOI between about 260 to about 340 kg-mm along the z axis. Conventional long irons typically have MOI ranges of about 35 to 50 about the x axis; about 225 to 260 about the y axis; and 240 to 270 about the z axis. The increase in MOI means the club head will have a higher resistance towards twisting resulting in straighter ball flights.

As best seen in FIG. 6, the distance $D_1$ between the center of gravity of the hosel sleeve weight 16 and the center line (C/L) of the club front face 34, is at least 2.40 inches, and the distance $D_2$ between the center of gravity of the toe plug 18 and the center line is at least 1.45 inches. The introduction of the toe plug 18 into the open port 31 at the lower portion of the toe causes not only the center of gravity of the club head to be lowered, but when in coordination with the placement of the sleeve weight 16 high on the hosel 14, as stated above, a club head 10 is created having improved MOI numbers about the x, y, and z axes. In addition, toe plugs 18 of varying weight and length, as well as sleeve weights 16 of various lengths, can adjust the swing weight of the club to match a golfer's specifications.

Other embodiments of the present invention can be created by utilizing the basic concept of combining the hosel sleeve weight 16 and the toe plug 18. One embodiment of the invention substitutes aluminum material for tungsten in the sleeve weight 16 and titanium for tungsten in the toe plug 18. The weight difference by these substitutions is then placed on a sole weight (not shown) in the sole portion 17, thus creating a club head with an extremely low center of gravity. A less severe lowering of the center of gravity may be accomplished by substituting a less dense material such as tungsten (7-10 g/cc) in the sleeve weight 16 and a titanium material (7-10 g/cc) instead of the tungsten in the toe plug 18. While the rear surface of the club head 10 is shown with a slightly concave shape, it is to be appreciated that this shape could be flat or even concave.

Figure 8:
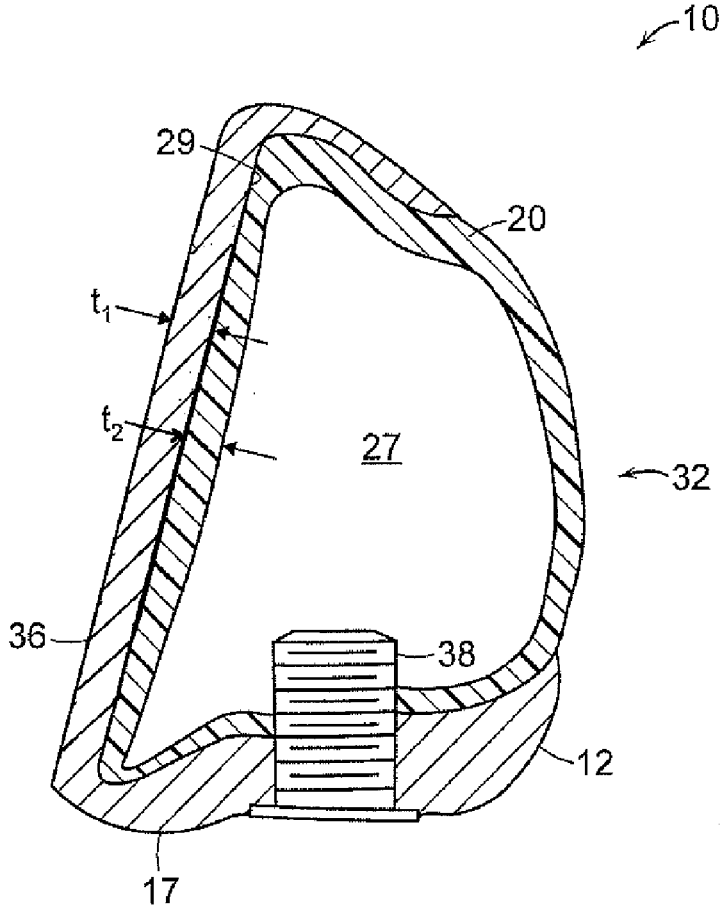
FIG. 8 is a cross-sectional view of the bladder-molded composite core of the present invention.

An embodiment of the invention is described in FIG. 8, which shows a sole plug 38, inserted through a port in the sole 17 of the club head body 12. This FIG. 8 illustrates the relationship of the composite core 20 to the cavity of the club head and the hollow body 27 that is therefore defined by the composite core 20. It is to be appreciated that the composite core 20 does not enclose the open port wherein the sole plug 38 is inserted. This inventive aspect is also true for the embodiment shown in FIGS. 1-7, wherein a toe plug 18 is used instead of a sole plug 38.

While embodiments of the present invention focus on irons, metal woods may also be manufactured utilizing these concepts. The hollow cavity of a metal wood provides for an internal volume between about 300 cc to 430 cc. Fairway wood versions of this metal wood have internal volumes between about 150 cc to 225 cc.

It is believed that those skilled in the pertinent art will recognize the improved inventive concepts of this invention. And they will readily understand that while the present invention has been described in association with a preferred embodiment thereof, and other embodiments illustrated in the accompanying drawings, numerous changes, modifications and substitutions of equivalents may be made therein without departing from the spirit and scope of this invention.

What is claimed is:

1. A golf club head comprising:

a substantially hollow body having a front face, a sole portion, a heel portion, a toe portion, and a hosel;

an impact plate inserted into a front opening defined in the front face;

an open port disposed in the lower toe portion having a receptacle defined therein;

the body made of a first material and a composite core of a second material less dense and more flexible than the first is inserted into the body through the open port;

the composite core inflated and expanded by pressurized gas wherein at least a portion of the composite core biasly juxtaposes against an inner surface of the body to form a hollow body of the second material having an internal volume between 20 cc to 50 cc wherein the composite core does not completely cover the port;

the body of the first material having a rear opening that is sealed by a visible portion of the inflated composite core;

a hosel sleeve weight inserted into the hosel; and a toe plug secured into the open port of the toe portion.

2. The club head of claim 1, wherein the center of gravity of the toe plug is at least 1.00 inches from a center line of the front face and the center of gravity of the hosel sleeve weight is at least 2.00 inches from the center line of the front face.

3. The club head of claim 1, wherein the toe plug varies in weight from about 10 grams to 30 grams.

4. The club head of claim 1, wherein the hosel sleeve weight varies in weight from about 16 grams to about 34 grams.

5. The club head of claim 1, wherein the length of the hosel sleeve weight varies from about 0.575 inch to about 1 inch.

6. The club head of claim 1, wherein the composite core is made from a lightweight material such as plastic or carbon graphite.

7. The club head of claim 6, wherein the composite core material has a density equal or less than 4.5 gm/cc.

8. The club head of claim 6, wherein the composite core material has a density equal or less than 1.65 gm/cc.

9. The club head of claim 1, wherein the toe plug and hosel sleeve weight are formed from tungsten and the body is formed from a 431 stainless steel.

10. The club head of claim 1, wherein the toe plug is made from titanium, the hosel sleeve weight is formed from aluminum, with an extra heavy weighted sole thereby creating a club head with an extremely low center of gravity.

11. A golf club head comprising:

a substantially hollow body having a front face, a sole portion, a heel portion, a toe portion, and a hosel;

an impact plate inserted into a front opening defined in the front face;

an open port disposed in the lower toe portion having a receptacle defined therein;

the body made of a first material, and a composite core of a second material less dense and more flexible than the first is inserted into the body through the open port;

the composite core inflated and expanded by pressurized gas wherein at least a portion of the composite core biasly juxtaposes against an inner surface of the front face to form a hollow body of the second material having an internal volume between 20 cc to 50 cc wherein said composite core does not completely cover said port;

a rear opening defined in the body of the first material that is sealed by a visible portion of the inflated composite core;

a hosel sleeve weight connected to the hosel; and a toe plug secured into the open port of the toe portion, wherein the positioning of the hosel sleeve weight and the toe plug cause an increase in the moment of inertia of the club head.

12. The club head of claim 11, wherein the center of gravity of the toe plug is at least 1.00 inch from a center line of the front face and the center of gravity of the hosel sleeve weight is at least 2.00 inches from the center line of the front face.

13. The club head of claim 12, wherein the toe plug varies in weight from about 10 grams to 30 grams.

14. The club head of claim 12, wherein the hosel sleeve weight varies in weight from about 16 grams to about 34 grams.

15. The club head of claim 12, wherein the length of the hosel sleeve weight varies from about 0.575 inch to about 1 inch.

16. A golf club head comprising:

a substantially hollow body made of a first material, and a composite core of a second material less dense than the first is inserted into the body through an open port;

the composite core inflated and expanded by pressurized gas wherein at least a portion of the composite core biasly juxtaposes against an inner surface of the body to form cavity having a volume between 20 cc to 50 cc wherein the composite ore does not completely cover the port; and a rear opening defined in the body that is sealed by a visible portion of the inflated composite core wherein the open port is different from the rear opening.

* * * * *